United States Patent [19]

Hoshi

[11] Patent Number: 4,657,182

[45] Date of Patent: Apr. 14, 1987

[54] TWO-STAGE TYPE OF FREELY ELONGATABLE SUCKING PIPE

[75] Inventor: Katsumasa Hoshi, Saitama, Japan

[73] Assignee: Showa Denko Kabushiki Kaisha, Tokyo, Japan

[21] Appl. No.: 738,651

[22] Filed: May 28, 1985

[30] Foreign Application Priority Data

May 31, 1984 [JP] Japan ..... 59-109690
Sep. 18, 1984 [JP] Japan ..... 59-140446[U]
Jan. 23, 1985 [JP] Japan ..... 60-6787[U]

[51] Int. Cl.[4] ..... A47G 21/18

[52] U.S. Cl. ..... 239/33; 285/260; 285/302

[58] Field of Search ..... 239/33; 215/1 A; 229/7 S; 220/90.2; 285/260, 302

[56] References Cited

U.S. PATENT DOCUMENTS 2,192,037 2/1940 Hamilton ..... 239/33
2,392,479 1/1946 Humbert ..... 229/7 S
3,346,187 10/1967 Mueller ..... 239/33
3,971,578 7/1976 Schemith ..... 285/260
4,152,017 5/1979 Abramson ..... 285/260 X

FOREIGN PATENT DOCUMENTS 904010 8/1962 United Kingdom ..... 239/33

*Primary Examiner*—Andres Kashnikow
*Attorney, Agent, or Firm*—Cushman, Darby & Cushman

[57] ABSTRACT

A two-stage type of freely elongatable sucking pipe comprising a larger-diameter pipe (e.g. for use as a drinking straw) member and a smaller-diameter pipe member inserted in the larger-diameter pipe member wherein the larger-diameter pipe member has a smaller diameter at the tip thereof to be brought into close contact with the outside surface of said smaller-diameter pipe member and/or the smaller-diameter pipe member has an expanded tip kept in close contact with the inside surface of the larger-diameter pipe member, the larger-diameter pipe member being made of a propylene type of polymer having a melt flow index of 7 to 14 g/10 min and stiffness of 10000 to 13000 kg/cm$^2$, and the smaller-diameter pipe member being made of polypropylene homopolymer having a melt flow index of 7 to 14 g/10 min and stiffness of at least 13500 kg/cm$^2$.

9 Claims, 11 Drawing Figures

TWO-STAGE TYPE OF FREELY ELONGATABLE SUCKING PIPE

BACKGROUND OF THE INVENTION (a) Field of the invention:

The present invention relates to a sucking pipe for potable water, etc., and more specifically to a two-stage type of freely elongatable sucking pipe made of synthetic resin.

(b) Description of the prior art:

Conventionally, there has already been known a two-stage type of freely elongatable sucking pipe consisting of a larger-diameter pipe member and a smaller-diameter pipe member so combined as to be shortened for convenient storage, carriage, transportation, attachement to vessels of beverage, and elongated for sucking.

Such a two-state type of freely elongatable sucking pipe is generally so designed as to assure close contact partially between the inside surface of the larger-diameter pipe member and the outside surface of the smaller-diameter pipe member, thereby preventing either pipe member from shifting or dropping by its own weight in use.

Further, such a two-stage type of freely elongatable sucking pipe must not allow leakage of breath or sucked liquid during suction. For this purpose, contact between the inside surface of the larger-diameter pipe member and the outside surface of the smaller-diameter pipe member must be as close as possible.

However, it is rather hard to assure perfectly close contact between the larger-diameter pipe member and the smaller-diameter pipe member.

SUMMARY OF THE INVENTION

A general object of the present invention is to provide a two-stage type of freely elongatable sucking pipe so designed as to assure contact partially between the inside surface of the larger-diameter pipe member and the outside surface of the smaller-diameter pipe member, and made of such materials as to assure perfectly close contact between the larger-diameter pipe member and the smaller-diameter pipe member.

The two-stage type of freely elongatable sucking pipe according to the present invention has such a construction as to assure contact partially between the inside surface of the larger-diameter pipe member and the outside surface of the smaller-diameter pipe member, said larger-diameter pipe member being made of a propylene type of polymer having a melt flow index of 7 to 14 g/10 min (ASTM D1238) and stiffness (ASTM D747) of 10000 to 13000 kg/cm$^2$, whereas said smaller-diameter pipe member being made of a propylene homopolymer having a melt flow index of 7 to 14 g/10 min (ASTM D1238) and stiffness (ASTM D747) of at least 13500 kg/cm$^2$.

DETAILED DESCRIPTION OF THE PREFERRED EMBODIMENTS

Figure 1:
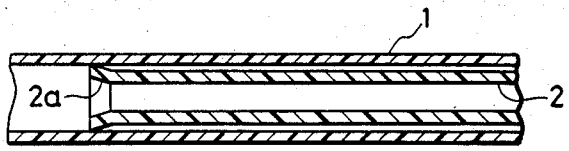
FIG. 1 shows a sectional view illustrating construction of an embodiment 1 of the sucking pipe according to the present invention.

FIG. 1 shows a sectional view illustrating the construction of the Embodiment 1 of the sucking pipe according to the present invention. The sucking pipe preferred as the Embodiment 1 consists of a larger-diameter pipe member 1 and a smaller-diameter pipe member 2 having a tip 2*a* expanded in a trumpet shape, said smaller-diameter pipe member 2 being inserted slidably in said larger-diameter pipe member. Further, expanded tip 2*a* of the smaller-diameter pipe member is kept in close contact with the inside surface of the larger-diameter pipe member 1, whereby said smaller-diameter pipe member cannot shift or drop by its own weight.

In the sucking pipe perferred as the Embodiment 1, the larger-diameter pipe member 1 is made of a propylene type of polymer having a melt flow index of 7 to 14 g/10 min and stiffness of 10000 to 13000 kg/cm$^2$, whereas the smaller-diameter pipe member 2 is made of a propylene homopolymer having a melt flow index of 7 to 14 g/10 min and stiffness if at least 13500 kg/cm$^2$.

Since the larger-diameter pipe member 1 and smaller-diameter pipe member 2 of the sucking pipe preferred as the Embodiment 1 are made of the materials described above, the smaller-diameter pipe member 2 can easily be inserted into the larger-diameter pipe member 2 even when the outside diameter of the expanded tip 2*a* of the smaller-diameter pipe member 2 is slightly larger, for example 1 mm$\sim$1/10 mm, than the inside diameter of the larger-diameter pipe member 1. That is to say, the present invention has made it possible to insert the smaller-diameter pipe member 2 equipped with the expanded tip slightly larger than the inside diameter of the larger-diameter pipe member 1 by selecting the propylene type of polymer having stiffness of 10000 to 13000 kg/cm$^2$ as the material of the larger-diameter pipe member to impart elasticity and certain degree of stiffness to said member. Further, adequate elasticity has been imparted to the expanded tip 2*a* by using propylene homopolymer having stiffness of at least 13500 kg/cm$^2$ as the material of the smaller-diameter pipe member. Accordingly, perfectly close contact is obtained between the relatively elastic larger-diameter pipe member 1 and the expanded tip 2*a* of the slightly elastic smaller-diameter pipe member 2, thereby providing the two-stage type of freely elongatable sucking pipe free from leakage of breath or liquid.

Moreover, since both the larger-diameter pipe member 1 and smaller-diameter pipe member 2 are made of synthetic resin materials having melt flow indices of 7 to 14 g/10 min, said members can easily be shaped by molding. If the materials of both the pipe members have melt flow indices smaller than 7 g/10 min, productivety will be remarkably lowered. If melt flow indices of the materials are larger than 14 g/10 min, in contrast, dimensional precision will be degraded.

As examples of the propylene type of polymer having a melt flow index of 7 to 14 g/10 min and stiffness of 10000 to 13000 kg/cm$^2$ to be used as the material of the larger-diameter pipe member, there are available ethylene propylene block copolymers having ethylene contents by weight of 3 to 40% and propylene homopolymers blended with polyethylene having low molecular weight, and so on. In addition, the object of the present invention can be accomplished sufficiently by using ethylene propylene block copolymers having ethylene content by weight of 3 to 40% blended with polyethylene having low molecular weight.

Out of the materials mentioned above, ethylene propylene block copolymers having ethylene content by weight lower than 10% will have too low pliability. Especially ethylene propylene block copolymers having ethylene contents by weight lower than 3% will have too low pliability to accomplish the object of the present invention. If ethylene contents by weight exceeds 40%, in contrast, the materials will have too high pliability.

When high density polyethylene is used as material of the larger-diameter or smaller-diameter pipe member, stiffness will be too low, thereby making it difficult to obtain dimensional precision enough to make the pipe members have truely circular section. When low density polyethylene is used as material of the pipe member, stiffness will be further too low, thereby degrading dimensional precision and circularity.

Figure 2:
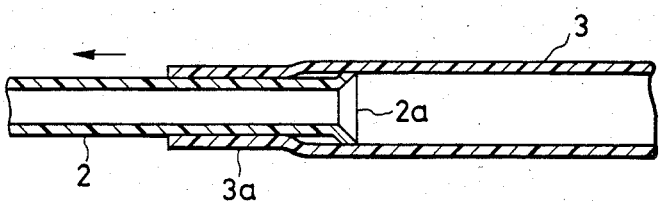
FIG. 2 shows a sectional view illustrating construction of an embodiment 2 of the sucking pipe according to the present invention.
Figure 3:
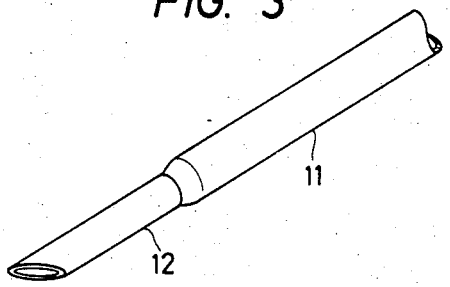
FIG. 3 shows a perspective view of said embodiment 2.

FIG. 2 and FIG. 3 show a sectional view and perspective view of the Embodiment 2 of the sucking pipe according to the present invention. In the Embodiment 2, the larger-diameter pipe member 3 has a tip 3*a* whose diameter is smaller than that of the rest section. The inside surface of the tip 3*a* is kept in contact with the outside surface of the smaller-diameter pipe member 2. Further, expanded tip 2*a* of the smaller-diameter pipe member 2 is in contact under pressure with the inside surface of the larger-diameter pipe member 3. In other words, the outside diameter of the expanded tip 2*a* of the smaller-diameter pipe member 2 is slightly larger than the inside diameter of the larger-diameter pipe member 3. In addition, the larger-diameter pipe member 3 and the smaller-diameter pipe member 2 respectively are made of the same materials as those of the Embodiment 1. Therefore, the smaller-diameter pipe member 2 having the expanded tip 2*a* can be inserted into the larger-diameter pipe member 3 and, after insertion, perfectly close contact is obtained between the expanded tip 2*a* and larger-diameter pipe member 3.

In the Embodiment 2 wherein tip 3*a* of the larger-diameter pipe member has a smaller-diameter, the expanded tip 2*a* is bought into contact with the tip 3*a* of the larger-diameter pipe member 3 and the smaller-diameter pipe member cannot come out when the smaller-diameter pipe member is pulled in the direction indicated by the arrow in FIG. 2.

Figure 4:
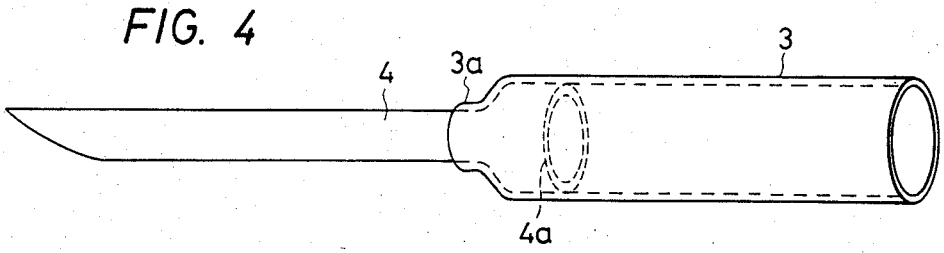
FIG. 4 shows a perspective view of an embodiment 3 of the sucking pipe according to the present invention.
Figure 5:
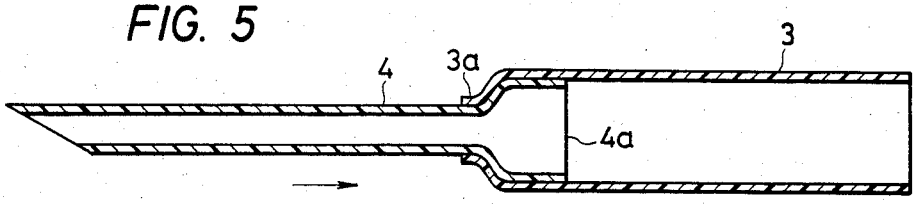
FIG. 5 and FIG. 6 show sectional views illustrating construction of said embodiment 3.
Figure 6:
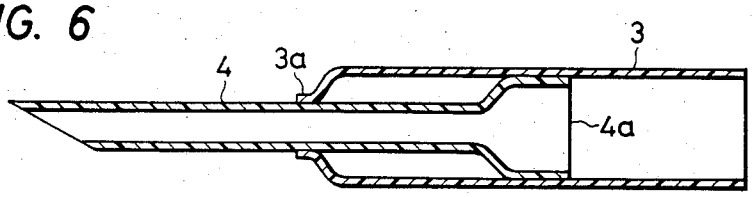

FIG. 4, FIG. 5 and FIG. 6 show a perspective view and sectional views respectively illustrating the Embodiment 3 of the sucking pipe according to the present invention. As is seen from these drawings, the Embodiment 3 adopts the larger-diameter pipe member having the tip 3*a* whose diameter is smaller like that used in the Embodiment 2. Further, tip 4*a* of the smaller-diameter pipe member 4 is expanded to from a cylinder. Accordingly, the smaller-diameter pipe member is stopped and cannot come off owing to cooperation between the tip 3*a* of the larger-diameter pipe member 3 and the expanded tip 4*a* of the smaller-diameter pipe member 4 when the smaller-diameter pipe member 4 is pulled out as shown in FIG. 4 and FIG. 5. In this case, it is preferable to design so as to assure close contact between the inside surface in the vicinity of the tip 3*a* of the larger-diameter pipe member 3 and the outside surface in the vicinity of the expended tip 4*a* of the smaller-diameter pipe member 4.

On the other hand, slide of the smaller-diameter pipe member can be stabilized by designing in such a manner that the inside surface of the tip 3*a* of the larger-diameter pipe member 3 is in close contact with the outside surface of the smaller-diameter pipe member 4 and the outside surface of the expanded tip 4*a* of the smaller-diameter pipe member 4 is in close contact with the inside surface of the larger-diameter pipe member when the smaller-diameter pipe member 4 is set in the condition shown in FIG. 6 after it is shifted in the direction indicated by the arrow in FIG. 5.

Also in the Embodiment 3, the larger-diameter pipe member 3 is made of a propylene type of polymer having a melt flow index of 7 to 14 g/10 min and stiffness of 10000 to 13000 kg/cm$^2$, and the smaller-diameter pipe member 4 is made of propylene homopolymer having a melt flow index of 7 to 14 g/10 min and stiffness of at least 13500 kg/cm$^2$. Accordingly, no hindrance is caused for slide of the smaller-diameter pipe member 3, and close contact is obtained between the frictional surfaces of both the pipe members, thereby allowing no leakage of breath or liquid.

Figure 7:
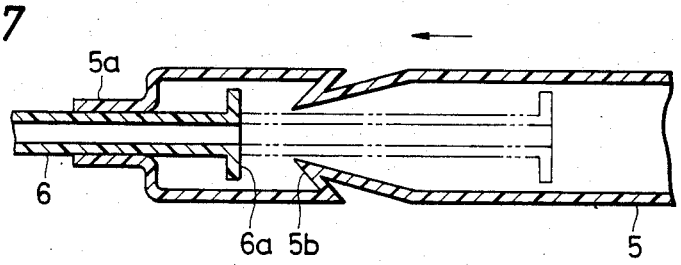
FIG. 7 shows a sectional view illustrating constraction of an embodiment 4 of the sucking pipe according to the present invention.

FIG. 7 shows a sectional view illustrating the construction of the Embodiment 4 of the sucking pipe according to the present invention. In this drawing, the reference numeral 5 represents a larger-diameter pipe member having a tip 5*a* smaller in its diameter and at least one convexity 5*b* tapered and gradually approaching the center axis of the pipe member 5 as it comes nearer the tip 5*a*. The reference numeral 6 designates a smaller-diameter pipe member equipped at its one end with a protrusion 6*a* extending outward.

When the smaller-diameter pipe member 6 of this embodiment is pulled in the direction indicated by the arrow in FIG. 7, the protrusion 6*a* of the smaller-diameter pipe member reaches the convexity 5*b* of the larger-diameter pipe member 5*b*. Then, the protrusion 6*a* of the smaller-diameter pipe member is pulled while pushing away the convexity 5*b* of the larger-diameter pipe member. For example, the smaller-diameter pipe member is pulled, for example, from the location shown in the chain line to the location shown in the solid line. When the smaller-diameter pipe member is pulled further, the protrusion 6*a* is brought into contact with the tip 5*a* of the larger-diameter pipe member, thereby stopping the shift of the smaller-diameter pipe member.

Even if a force is applied to the smaller-diameter pipe member to shift it in the opposite direction in use, the protrusion 6*a* of the smaller-diameter pipe member 6 is brought into contact with the convexity of the larger-diameter pipe member, thereby preventing the smaller-diameter pipe member from shifting. Accordingly, the pipe as a whole cannot be shortened in use.

Figure 8:
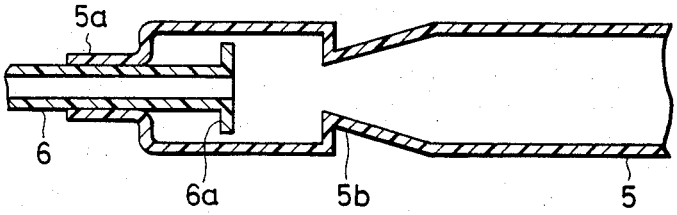
FIG. 8 and FIG. 9 shows sectional views illustrating variants of said embodiment 4.

FIG. 8 shows a variant of the Embodiment 4 having the tapered convexity 5*b* in a modified form.

Figure 9:
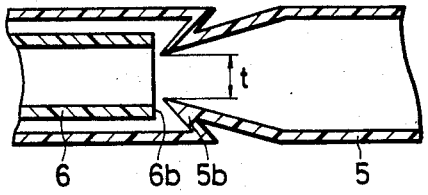

In the Embodiment 4, the smaller-diameter pipe member need not have the convexity as shown in FIG. 9. Speaking concretely, when the spacing t between the convexities of the larger-diameter pipe member is smaller than the outside diameter of the smaller-diameter pipe member 6, the sucking pipe cannot be shortened while it is used in its elongated condition with the smaller-diameter pipe member pulled out. However, the smaller-diameter pipe member comes out completely from the larger-diameter pipe member when the smaller-diameter pipe member is shifted in the direction to lengthen the sucking pipe as a whole.

Figure 10:
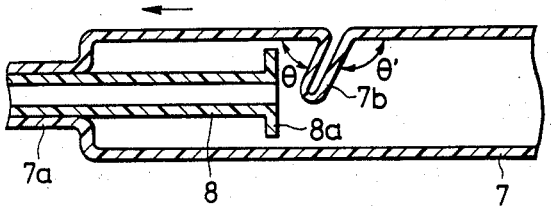
FIG. 10 shows a sectional view illustrating construction of an embodiment 5 of the sucking pipe according to the present invention.

FIG. 10 shows a sectional view illustrating the construction of the Embodiment 5 of the sucking pipe according to the present invention. In this embodiment, at least one rod-like protrusion is formed on the inside surface of the larger-diameter pipe member. This rod-like protrusion extends obliquely toward the tip 7*a* of the larger-diameter pipe member 7, and satisfies relationship of $\theta<90°$ or $\theta'<90°$.

Also in this embodiment, the smaller-diameter pipe member 8 can be shifted while flexing the rod-like protrusion 7*b* when said pipe member is pulled in the direction indicated by the arrow. When the sucking pipe as a whole has the largest total length with the smaller-diameter pipe member located at the position shown in FIG. 10, however, the rod-like protrusion prevents the smaller-diameter pipe member from shifting in the opposite direction. The larger-diameter pipe member and smaller-diameter pipe member adopted for the Embodiments 4 and 5 are made of the same materials as those selected in the other embodiments. Therefore, the tip of the larger-diameter pipe member having the smaller-diameter is brought into close contact with the smaller-diameter pipe member, thereby preventing no leakage of breath or liquid and assurung stable slide.

Figure 11:
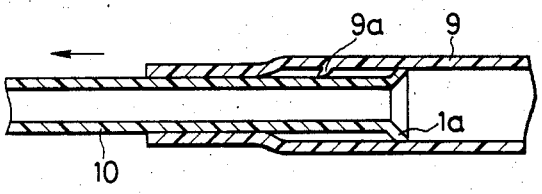
FIG. 11 shows a sectional view illustrating construction of an embodiment 6 of the sucking pipe according to the present invention.

The projection formed in the larger-diameter pipe member of the Embodiment 4 may have circular, spot-like or any other cross section. In the Embodiments shown in FIG. 7 through FIG. 10, protrusion 6*a* or 8*a* of the smaller-diameter pipe member 6 or 8 is not in contact with the inside surface of the larger-diameter pipe member 5 or 7. However, it is more preferable to bring this protrusion 6*a* or 8*a* into contact with the larger-diameter pipe for preventing leakage of breath or liquid. In such a case, the convexity 5*b* or 7*b* of the larger-diameter pipe member must project a little from the inside surface of said pipe member. For example, it will be possible to contrive a sixth embodiment consisting of a larger-diameter pipe member having the convexity 9*a* and a smaller-diameter pipe member 10 having the protrusion 10*a* in the forms shown in FIG. 11.

The two-stage type of freely elongatable sucking pipe described with reference to the preferred embodiments are actually made of rather thin materials though they are traced thick in the drawings. Therefore, it is not easy to judge whether the sucking pipe consists of one or two pipe members. As a result, the two-stage type of freely elongatable sucking pipe may be regarded as a single-member type of pipe and used in the shortened condition without pulling out the smaller-diameter pipe member.

Further, at the stage to manufacture two-stage type of freely elongatable sucking pipe, inconvenience will be constituted when the larger-diameter pipe member is hardly distinguishable from the smaller-diameter pipe member.

In order to eliminate this defect, it is preferable to manufacture the larger-diameter pipe member and smaller-diameter pipe member in different colors, for example, the larger-diameter pipe member in red and the smaller-diameter pipe member in white.

Furthermore, it is possible to select the same color in different shades instead of different colors. Moreover, it is possible to prepare one type of the pipe members in the natural color of its material without being colored are color the other type of pipe member only. In such a case, coloring material will be consumed in half the quantity.

In order to prepare a colored sucking pipe, the pipe members can be colored at the stage to manufacture, for example, by extrusion molding. Since the larger-diameter pipe member and a smaller-diameter pipe member are molded separately at this stage, manufacturing stages cannot be incressed by coloring the pipe members.

As is understood from the foregoing desctiptions, the two-stage type of freely elongatable sucking pipe according to the present invention assured perfect close contact between the larger-diameter pipe member and the smaller-diameter pipe member without causing no hindrance on slide of both the pipe members when said members are prepared in the forms illustrated in the Embodiments since the larger-diameter pipe member is made of a propylene type of polymer having a melt flow index of 7 to 14 g/10 min and stiffness of 10000 to 13000 kg/cm$^2$, and the smaller-diameter pipe member is made of propylene homopolymer having a melt flow index of 7 to 14 g/10 min and stiffness of at least 13500 kg/cm$^2$.

I claim:

1. A two-stage type of freely elongatable sucking pipe, comprising:

a larger-diameter pipe member and a smaller-diameter pipe member, each having two opposite ends, a longitudinal bore and a circumferentially-extending wall with an inner surface and an outer surface;

said smaller-diameter pipe member having a portion of the length thereof telescopically received in the longitudinal bore of said larger-diameter pipe member, so that telescopic overlapping of said smaller-diameter pipe member and said larger-diameter pipe member is delimited between a respective end of each said pipe member, each said respective end being provided on a tip portion of the respective said pipe member;

at least one of a circumferentially-extending portion of said smaller-diameter pipe member in the vicinity of said tip of said smaller-diameter pipe member and a circumferentially-extending portion of said larger-diameter pipe member in the vicinity of said tip of said larger-diameter pipe member is kept liquid-tightly in contact with said wall of the respective other of said pipe members;

said larger-diameter pipe member being made of a polypropylene type of polymer having a melt flow index of 7 to 14 g/10 min and stiffness of 10000 to 13000 kg/cm$^2$; and said smaller-diameter pipe member being made of propylene homopolymer having a melt flow index of 7 to 14 g/10 min and stiffness of at least 13500 kg/cm$^2$.

2. A two-stage type of freely elongatable sucking pipe according to claim 1 wherein said larger-diameter pipe member is made of ethylene propylene block copolymer having ethylene content by weight of 3 to 40%.

3. A two-stage type of freely elongatable sucking pipe according to claim 1 wherein the tip of said smaller-diameter pipe member has an expanded trumpet-shaped portion to be brought into contact with the inside surface of said larger-diameter pipe member upon maximum pipe elongation.

4. A two-stage type of freely elongatable sucking pipe according to claim 3 wherein said expanded portion of said smaller-diameter pipe member has a cylindrical shape.

5. A two-stage type of freely elongatable sucking pipe according to claim 1 wherein the tip of said larger-diameter pipe member has a cylindrical shape of a small diameter and said cylindrical portion is kept in contact with the outside surface of said smaller-diameter pipe member.

6. A two-stage type of freely elongatable sucking pipe according to claim 5 wherein said smaller-diameter pipe member has an expended trumpet-like portion at one end and said expanded tip is kept in close contact with the inside surface of said larger-diameter pipe member.

7. A two-stage type of freely elongatable sucking pipe according to claim 5 wherein said smaller-diameter pipe member has an expanded cylindrical portion and said expanded portion is kept in close contact with the inside surface of said larger-diameter pipe member.

8. A two-stage type of freely elongatable sucking pipe accoridng to claim 5 wherein said larger-diameter pipe member is equipped on the inside surface thereof with tapered convexity protruding toward said cylindrical portion.

9. A two-stage type of freely elongatable sucking pipe accoridng to claim 5 wherein said larger-diameter pipe member is equipped on the inside surface thereof with rod-like convexity protruding obliquely toward said cylindrical portion.

* * * * *